United States Patent [19]

Stehlin et al.

[11] 4,144,826

[45] Mar. 20, 1979

[54] SEWING MACHINE FOR MAKING DECORATIVE STITCH PATTERNS

[75] Inventors: Bernhard Stehlin; Joachim Wilken, both of Ettlingen, Fed. Rep. of Germany

[73] Assignee: Dorina Nähmaschinen GmbH, Fed. Rep. of Germany

[21] Appl. No.: 842,341

[22] Filed: Oct. 14, 1977

[30] Foreign Application Priority Data

Oct. 22, 1976 [DE] Fed. Rep. of Germany ..... 2647763

[51] Int. Cl.[2] ..... D05B 3/02

[52] U.S. Cl. ..... 112/158 E; 192/53 D

[58] Field of Search ..... 112/158 E, 220; 192/53 D

[56] References Cited

U.S. PATENT DOCUMENTS

| | | | |
|---|---|---|---|
| 3,713,519 | 1/1973 | Ruget | 192/53 D |
| 4,074,641 | 2/1978 | Tholander et al. | 112/158 E X |
| 4,086,861 | 5/1978 | Ketterer et al. | 112/158 E |

*Primary Examiner*—Peter Nerbun

*Attorney, Agent, or Firm*—McGlew and Tuttle

[57] ABSTRACT

The sewing machine includes respective setting members for adjusting the overstitch width and the stitch length, with the setting members being adjusted by an actuating mechanism responsive to control signals of a program control system, the control signals corresponding to the stitches to be made. The power for driving the actuating mechanism is derived from the continuously operating main shaft of the sewing machine, through a clutch or clutches whose moment to be transmitted is controllable, such as electromagnetic clutches. In one embodiment of the invention, a single electromagnetic clutch is provided for each setting member and includes a first clutch disk connected to the respective setting member to rotate therewith and a second clutch disk secured to a shaft continuously rotated by the main shaft of the machine. A spiral spring is provided to act to rotate the respective setting member in a direction opposite to the direction of rotation thereof by the associated clutch. In a second embodiment of the invention, two clutches are provided to rotate each setting member, each clutch including a first clutch disk. One clutch includes a second disk rotated by a shaft continuously driven by the main shaft, and the other clutch includes a second disk rotated directly by the main shaft, the two second clutch disks rotating in respective opposite angular directions. Thereby, the setting member is adjusted in accordance with the relative moments exerted by the two clutches.

10 Claims, 7 Drawing Figures

SEWING MACHINE FOR MAKING DECORATIVE STITCH PATTERNS

FIELD AND BACKGROUND OF THE INVENTION

In known sewing machines for making successive stitches of decorative stitch patterns, of the type including setting members for adjusting the overstitch width and the stitch length, with the setting members being adjusted by an actuating means through control signals of a program control system, with the control signals corresponding to the stitches to be made, a rather high power gain is necessary for adjustment of the actuating means controlled by an electronic program control system in order to enable the actuating means to furnish the high setting forces required to move the setting members for displacement of the needle bar and/or the fabric feed. For this reason, in the known sewing machines, structural parts having a very low inertia are used so that the cost of the control apparatus for the power gain will not become unnecessarily high. However, a high power gain is necessary because, from the control signal of the program control system only a very low electric power is available, and this must be amplified enormously for satisfactory control of the movement of the known actuating means in order to furnish the high setting forces required for actuating of the setting means. Furthermore, a high electric power gain is very difficult to control and requires considerable expense for adaptation and compensation members in order to avoid deviations from the linear characteristics of the individual amplifier stages.

SUMMARY OF THE INVENTION

The objective of the invention is to provide a simple, quickly responding actuating means of very high power gain. To achieve this objective, the problem solved by the present invention is to take off the setting force, for adjusting the setting member, from a special drive. Advantageously, the existing sewing machine drive may be used to this end.

To solve this problem, the actuating means in accordance with the invention consists of a clutch, whose moment to be transmitted is controllable, and having one clutch disk in connection with the setting member and another clutch disk in connection with a continually operating drive. A reset means, acting in a direction opposed to the direction of rotation of the clutch, is provided for the setting member.

In another, and equivalent, solution, the actuating means comprises two clutches acting in opposite directions, and whose moments to be transmitted are controllable, with one set of clutch disks being in connection with the setting member and the other set of clutch disks being in connection with a continually operating drive. The term "controllable", as used herein and hereinafter, is to be understood to mean not only the influence of the magnitude of the transmission moment of a clutch, but moreover the variability of the engagement time of a clutch capable of impulse type engagement and disengagement, provided that this results in a controllable total transmission moment.

Both solutions provided by the present invention have the essential advantage that very great forces can be controlled with very low electronic power, as the setting force is derived from a drive whose strength can be selected as desired. Owing to this, the drive delivering the setting energy need not be itself accelerated in the setting operations, and the inherent inertia of the drive may be relatively high. The cost of circuitry necessary for such a control thus can be kept low as compared with the known arrangements. Additionally, it suffices to reduce the reduction of the inertia mass of the transmission elements to an amount acceptable in terms of cost, which is advantageous per se. Due to the existing greater damping of friction at the transmission members, relative to known arrangements, much less expenditure is required in the control provided for the invention.

A very simple solution for the reset means is obtained in that it is a spring disposed between the setting member and the housing of the sewing machine.

Advantageously, the setting member can be designed as a cam disk with a spiral cam track which is contacted by a take-off which actuates the control of the needle-bar rocker and/or of the fabric feed. The portion of the cam track operative for the control may extend over the entire circumference of the cam disk or only a part of the circumference thereof. The operative length of the cam track is influenced by the transmission ratio between the clutch driving disk and the clutch driven disk, and by the duration of movement of the setting member as specified by the movement cycles of the sewing tools. To support the reset force of the spiral spring, the pitch direction of the cam track of the setting member is co-directional with the force direction of the spring.

In accordance with a further embodiment of the invention, the setting means may be connected with a nub on a threaded spindle which spindle is connected with one set of clutch disks of a pair of clutches, and with a take-off which effects control of the needle and/or the fabric feed. In a particularly simple and inexpensive arrangement, the driven clutch disk of each clutch is in driving connection with the main shaft of the machine, preferably through a transmission gear. The power reserve available at the main drive of the machine thus can be used as the setting force for adjusting the setting member. By the reduced driving speed of the clutch disk, relative to the angular velocity of the main shaft, a better power transmission is obtained in the clutch. With the clutch disk being driven by the main shaft of the machine, there results a further advantage that, at a low sewing speed, also the speed of rotation of the driven clutch disk is reduced.

A setting drive which is optimally regulated as to moment a little apparatus cost can be provided with the use of slip-ringless electromagnetic clutches, which are able to transmit a very high setting moment in proportion to their structural size. By means of a controllable electromagnetic field, a clutch disk, designed as an armature disk, can then be pressed more or less strongly against a friction covering rotatable with the other clutch disk, in accordance with the magnetic field strength, whereby a setting moment which is controllable in a sensitive manner is transmitted.

An object of the invention is to provide an improved sewing machine for making successive stitches of decorative stitch patterns.

Another object of the invention is to provide such a sewing machine, including a simple, quickly responding actuating means of very high power gain.

A further object of the invention is to provide such a sewing machine in which the setting force for adjusting a setting member, provided to adjust the overstitch width and/or the stitch length, is obtained from a special drive of the sewing machine.

Yet another object of the invention is to provide such a sewing machine in which the special drive is constituted by the existing sewing machine drive.

For an understanding of the principles of the invention, reference is made to the following description of typical embodiments thereof as illustrated in the accompanying drawings.

DESCRIPTION OF THE PREFERRED EMBODIMENTS

Figure 1:
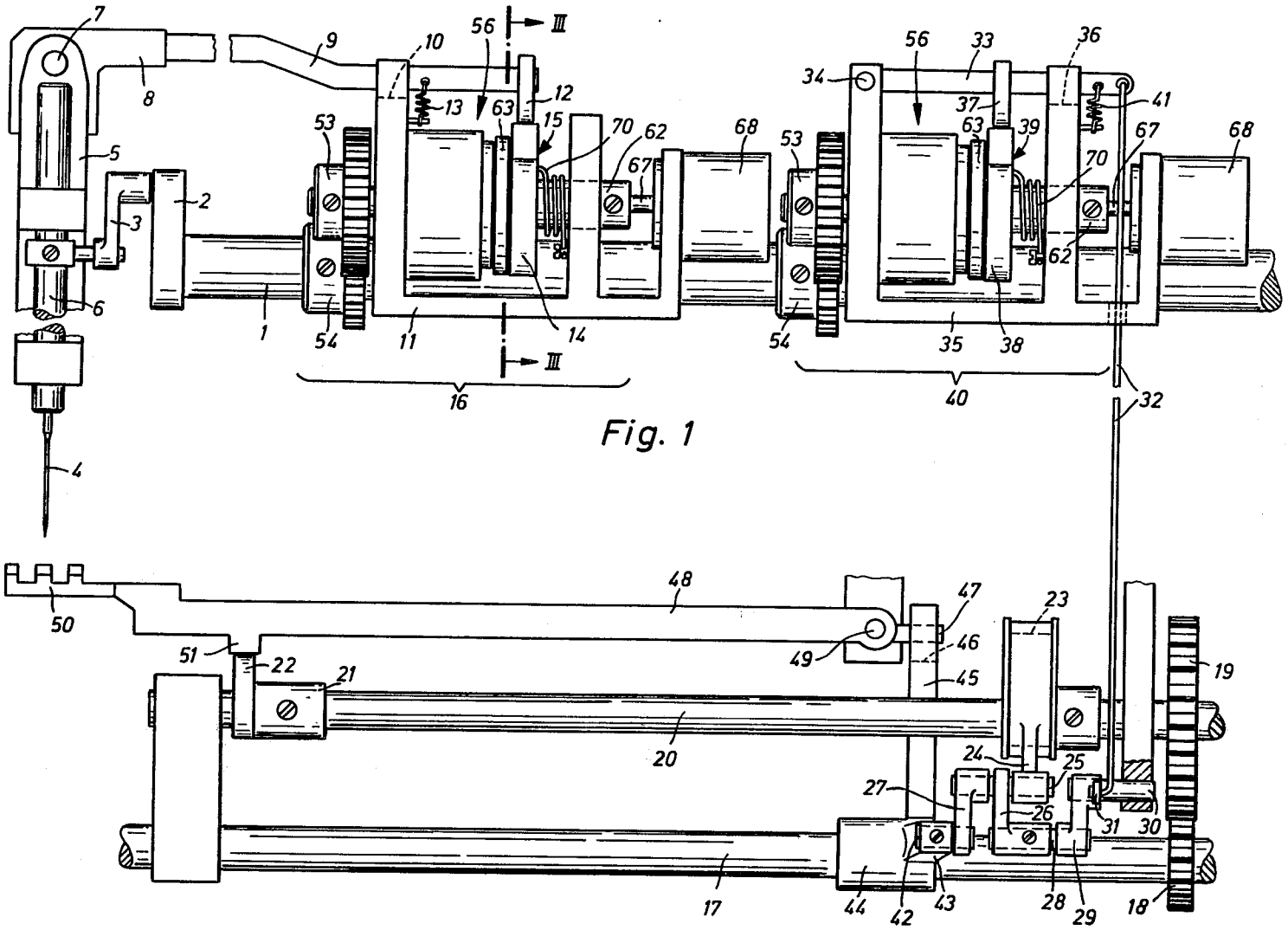
FIG. 1 is a view of the first embodiment of the actuating means for the overstitch width and the stitch length control of a sewing machine, with unessential parts being omitted.

Referring first to FIG. 1, a sewing machine for making successive stitches of decorative stitch patterns is illustrated as having a main shaft 1 which, through a crank 2 and a link 3, effects vertical stroke movements of a needle bar 6, mounting a needle 4, and mounted in a guide rocker 5. Guide rocker 5 is mounted in the housing (not shown) of the sewing machine by means of a pin 7.

An angle piece 8 is fixedly connected with guide rocker 5 and carries an extension arm 9 which is guided in a slideway 10 of a bearing support 11 secured in the housing of the sewing machine. At its free end, extension arm 9 carries a take-off 12 which, under the bias of a tension spring 13, bears against a spiral cam track of a setting member 15, as more clearly shown in FIG. 3. At one end, spring 13 is attached to extension arm 9 and, at the other end, to bearing support 11. Setting member 15 is part of an actuating means 16 for control of the overstitch width of needle 4, as described hereinafter.

Through a chain drive which has not been illustrated, main shaft 1 drives a lower shaft 17 on which there is secured gear 18 meshing with a gear 19 secured on a shaft 20 extending parallel to shaft 17, in the housing of the sewing machine. A lifting eccentric 21, carrying a cam 22, is secured by a screw to shaft 20, and shaft 20 has also secured thereto an eccentric 23 embraced by an eccentric rod 24 having two links 26 and 27, pivotally connected thereto by means of a stud 25. Link 26 is pivotally connected, through a stud 28, with an angle lever 29 rotatably mounted on a pivot 30 secured in the housing of the sewing machine, and is also connected with a lever arm 33 through an arm 31 and a rod 32. Lever arm 33 is mounted, by means of a stud 34, in a bearing support 35 secured in the sewing machine housing, and is guided in a slideway 36 in a bearing support 35. Lever arm 33 carries a take-off 37 which bears against a spiral cam track 38 of a setting member 39 which is part of an actuating means 40 for control of the stitch length of the sewing machine. A tension spring 41 is connected between lever arm 33 and bearing support 35 to assure contact of take-off 37 with setting member 39.

Link 27 is pivotally connected with an arm 43 of a rocking lever 44, mounted on shaft 17, through the medium of a pivot stud 42. A second, upwardly extending arm 45 of rocking lever 44 has a guide slot 46 at its free end receiving a pin 47. Pin 47 is secured to a supporting arm 48 mounted on a horizontal pivot 49 secured in the housing of the sewing machine to extend parallel with the direction of feed, arm 48 being displaceable axially of pivot 49. At its free end, supporting arm 48 carries a fabric feed 50 for transport of the work stitched by needle 4 in cooperation with a looper, which latter has not been shown. Arm 48 is supported on cam 22 of lifting eccentric 21, through the medium of a downwardly directed ridge 51.

The actuating means 16 and 40 are identical in their construction, so that it will be necessary to describe only the actuating means 16, it being born in mind that similar elements of actuating means 16 and 40 are designated with the same reference numerals.

Actuating means 16 is mounted in bearing support 11 which rotatably mounts a shaft 52 which is in drive connection with a gear 54, secured on main shaft 1, through a gear 53 secured on shaft 52. A clutch disk 55 of an electromagnetic clutch 56 is secured on shaft 52 and, behind clutch disk 55, there is a coil or winding holder 57 fixedly connected with bearing support 11 and mounting an annular magnetic coil 58. Clutch disk 55 has an annular clutch portion 59 of U-shaped cross section, which carries an annular friction insert 60. The outer cylindrical wall 61 of coil holder 57 extends axially over a major part of the circumferential wall of clutch portion 59. Setting member 15 is fixedly connected with a shaft butt 62 loosely mounted on shaft 52, and carries a clutch disk 63, designed as an armature disk, which is adjacent to friction insert 60 with a small air gap being provided therebetween.

Figures 2, 3:
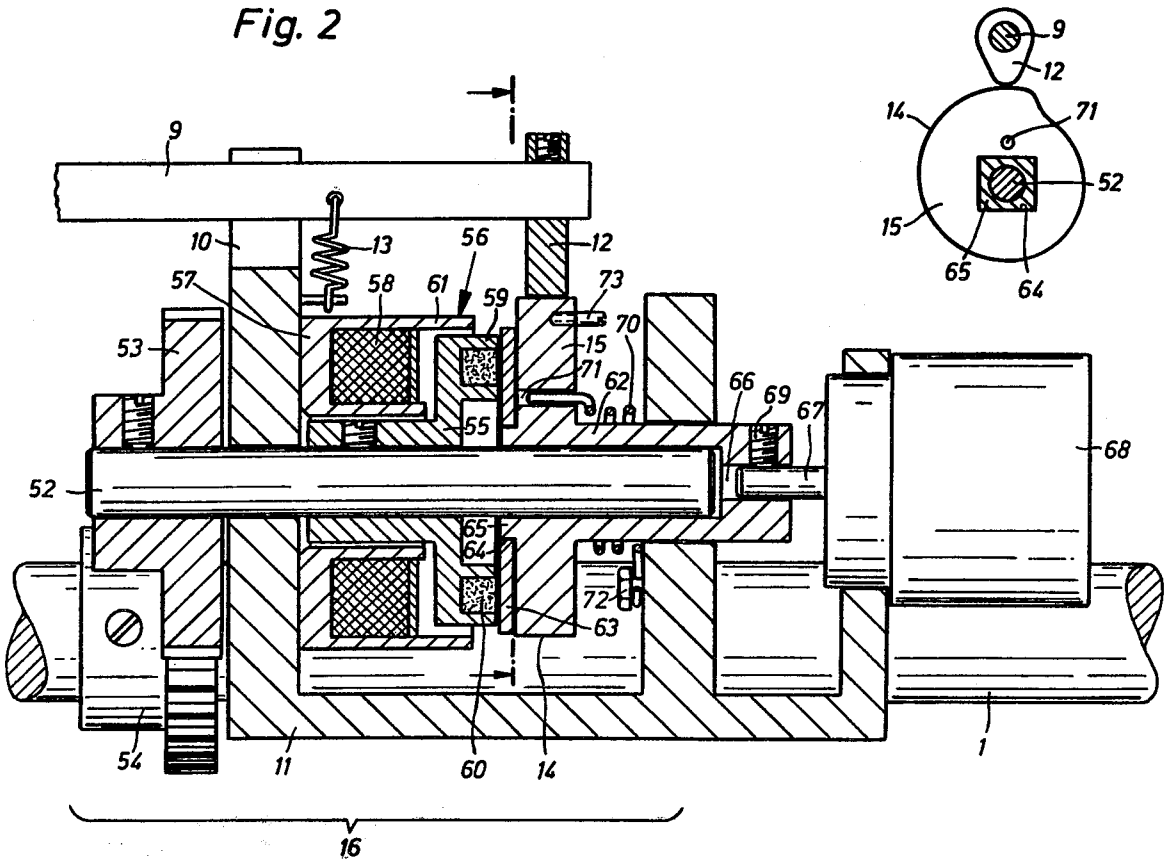
FIG. 2 is an enlarged sectional view through the actuating means for the control of the overstitch.
FIG. 3 is a sectional view taken along the line III—III of FIG. 1.

Clutch disk 63 is formed with a square opening 64, as best seen in FIG. 3, into which there extends a square shoulder 65 of shaft butt 62 which latter extends beyond shaft 52. On this protruding end, shaft butt 62 is formed with a bore 66 coaxially of shaft 52, into which there extends an axle 67 of a potentiometer 68 fastened on bearing support 11, axle 67 being secured in bore 66 by means of a screw 69.

A spiral spring 70 embraces shaft butt 62 and has one end engaged in a bore 71 in setting member 15 and its other end bearing against a trunnion screw 72 secured in bearing support 11. Spiral spring 70 is so tensioned that it rotates setting member 15 until a pin 73, screwed into the setting member, abuts on a stop (not shown) connected with bearing support 11, in a direction opposed to the direction of rotation of shaft 52 through gears 53 and 54.

Actuating means 40 differs from actuating means 16 only in the different design of the setting member 39, whose cam track 38 is adapted to the required different control function.

Figure 7:
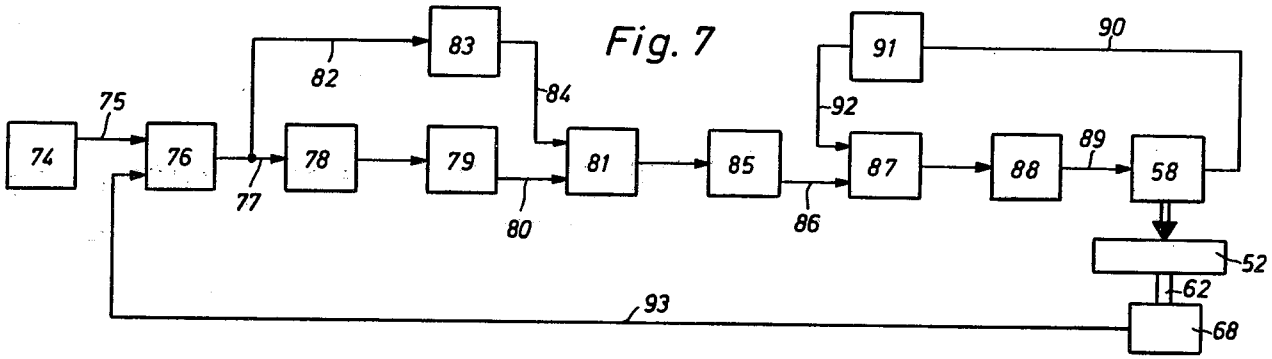
FIG. 7 is a block diagram of the control for the actuating means illustrated in FIG. 2.

FIG. 7 is a block diagram of a control loop whereby the two actuating means 16 and 40 can be controlled, each actuating means 16 and 40 requiring a separate control loop. As the two control loops are identical in design, only the control loop for the needle control will be described.

From a program control member 74, designed in a manner known to those having average skill in the art, and in which stitch formation data are stored, a set-value pulse, corresponding to the desired side deflection of needle 4, is supplied through line 75 to the input of a summing amplifier 76. The output signal of summing amplifier 76 is supplied, through a line 77, through a differential amplifier 78 and, to a sealing amplifier 79, and a line 80, to a difference amplifier 81. The proportional signal, present at the output of summing amplifier 76, is supplied, through a line 82, to the difference amplifier 81 only through a scaling amplifier 83 and a line 84. The output signal of difference amplifier 81 is rectified in a rectifier 85 and supplied, through a line 86, to a power amplifier 87, with complementary Darlington end stage 88, to obtain a high current and voltage gain. Darlington end stage 88 controls, through a line 89, magnetizing winding 58 of electromagnetic clutch 56.

Feedback of magnetizing or energizing coil 58 is effected through a line 90, a measuring resistor 91 and a line 92 to the input of power amplifier 87, whereby a voltage-current conversion is obtained. Control of winding 58 is thus effected as over a pure current control, and its inductance can exert no influence on the control loop.

Potentiometer 68, which is connected with setting member 15 through shaft butt 62, furnishes an electric signal which is proportional to the position of setting member 15. Through a line 93, this signal is supplied to the input of summing amplifier 76, with a corresponding sign. Through the means of a pulse generator, which has not been shown but which responds in the rhythm of the main shaft 1, the control loop of FIG. 7 is influenced in a known manner so that the movement changes of setting member 15, controlled by winding 58, occur during the non-inserted phase of needle 4.

The system operates in a manner which will now be described. Upon driving of the sewing machine, shaft 52 is driven by main shaft 1 through gears 54 and 53 of actuating means 16, and clutch disk 55 of electromagnetic clutch 56, which is firmly connected to shaft 52, rotates with the latter. Clutch energizing winding 58 is energized in accordance with the given control voltage corresponding to the size of the overstitch width of the next stitch to be controlled by the control loop, whereby clutch member 59 is magnetized correspondingly through the magnetic field exerted on it by winding 58. This causes clutch disk 63, mounted displaceably on shoulder 65 of shaft butt 62, to be pressed against friction insert 60 more or less strongly according to the intensity of the magnetic field, and to be driven by clutch disk 55. Potentiometer 68, whose axle 67 is fixedly connected with clutch disk 63, is also rotated and the actual position of setting member 15 picked up by potentiometer 68 is supplied to summing amplifier 76 through line 93 and is compared in the summing amplifier with the set signal supplied by line 75, and used to generate a magnetic field, of corresponding strength, in energizing winding 58.

As the actual position of setting member 15 approaches its set position, supplied by the set value signal of program control member 74, the strength of winding 58, acting on clutch disks 55 and 63, diminishes as a result of the reduction of the difference, available at summing amplifier 76, between the signals of program control member 74 and potentiometer 68. The magnetic field strength in electromagnetic clutch 56 is thus reduced until an equilibrium is established between the restoring moment of sprial spring 70 and the controlled entrainment movement of the frictional connection between clutch disks 55 and 63. The newly attained rotary position of setting member 15 is maintained by slippage between clutch member 59 and clutch disk 63 until the arrival of a new voltage pulse from program control section 74 of the control loop, whereupon the described control operation is repeated.

Upon rotation of setting member 15, extension arm 9 is rotated, through cam track 14 of setting member 15, according the changed rotary position of setting member 15, together with guide rocker 5, so that needle 4 is adjusted to the position of its next insertion as dictated by program control section 74.

Control of actuating means 40 for adjusting the feed length of fabric feed 50 takes place in the same manner. Upon rotation of setting member 39, the latter pivots, through take-off 37, lever arm 33 in accordance with the control of energizing winding 58 by the supplied control voltage of the control loop for the stitch length of fabric feed 50. Through rod 32 and angle lever 29, lever arm 33 pivots stud 28 which serves as a pivot axis for link 26, relative to stud 42. During the swinging movements of stud 25 through eccentric rod 24, therefore, link 26 executes a pure rotational movement about stud 28, whereas link 27 executes, in addition to this rotational movement, a relative movement about stud 42. This relative movement is transmitted to supporting arm 48 through rocking lever 44, as a sliding movement. Arm 48 slides to and fro on pivot 49 while imparting, to fabric feed 50 secured to its end, sliding movements whose magnitude depends on the rotary position of setting member 39 and thus on the displacement difference between studs 38 and 42. The pitch of cam track 38 of setting member 39 is so selected that feed movements of fabric feed 50 can be carried out, which are variable between the maximum stitch length of fabric feed 50 in the forward direction and the maximum stitch length possible in the backward direction. During the sliding movements of fabric feed 50, cam 22 of lifting eccentric 21 raises supporting beam 48 rhythmically, whereby the teeth of fabric feed 50 can act on the material to be sewn through the stitch plate of the sewing machine, which stitch plate has not been shown.

Figure 4:
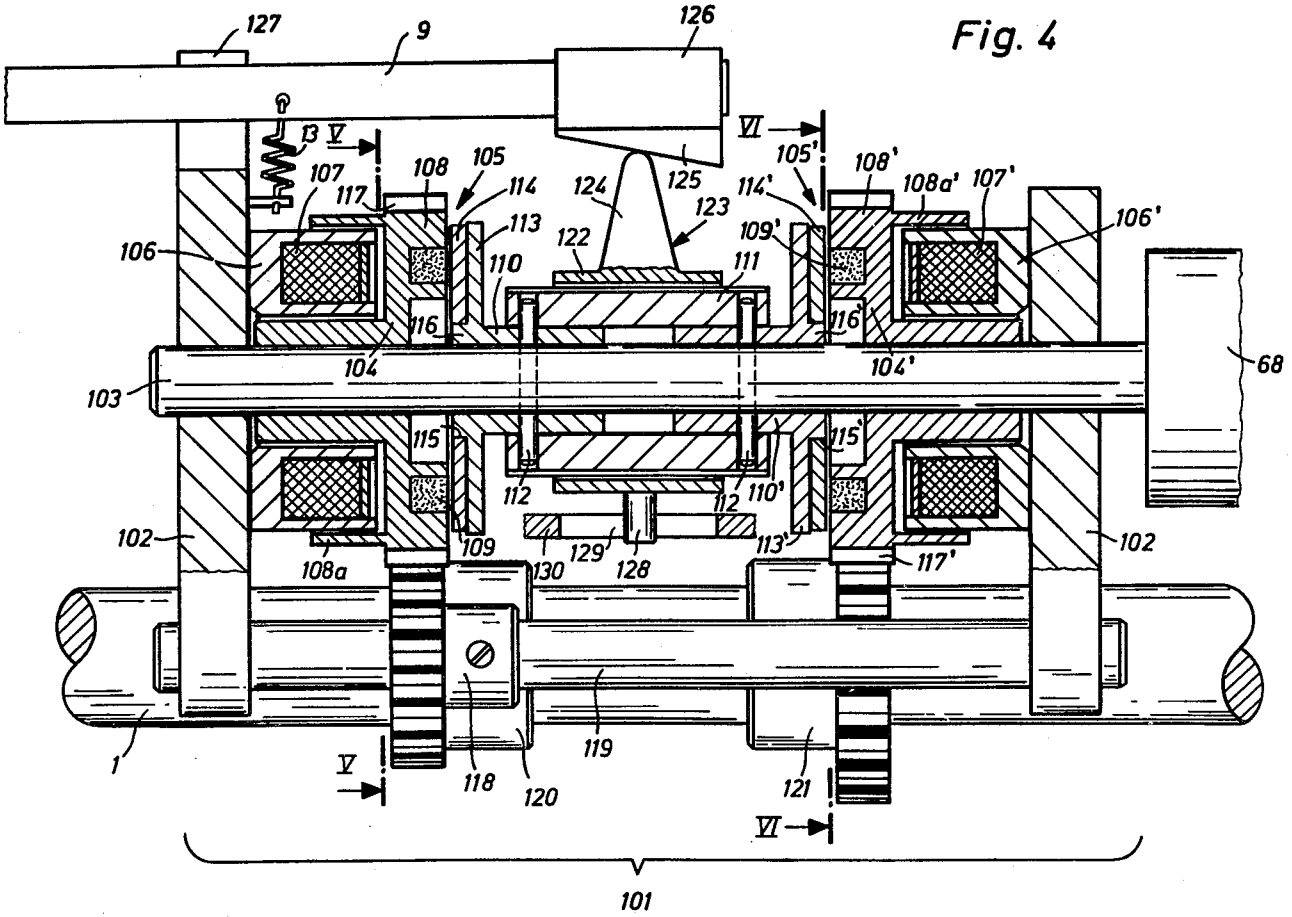
FIG. 4 is a view, similar to FIG. 2, of the actuating means of a second embodiment of the invention.
Figure 6:
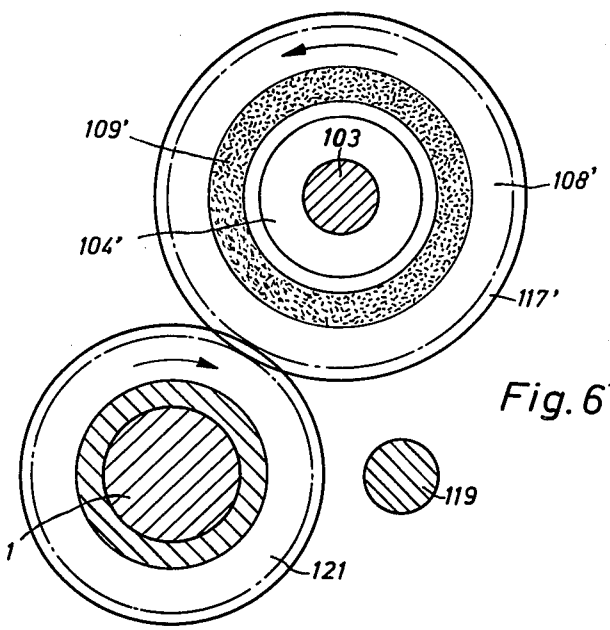
FIG. 6 is a sectional view taken along the line VI—VI of FIG. 4.
Figure 5:
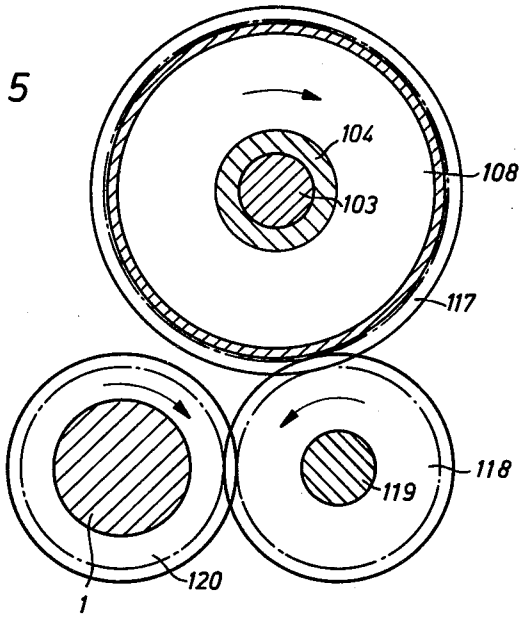
FIG. 5 is a sectional view taken along the line V—V of FIG. 4.

FIGS. 4–6 illustrate an actuating means 101 in accordance with the second embodiment of the invention, and actuating means 101 can be substituted for actuating means 16 and 40 in the same sewing machine. Actuating means 101 is mounted in a bearing support 102, in which there is also mounted a rotatable shaft 103 on which there are loosely mounted a clutch disk 104, of an electromagnetic clutch 105, and a clutch disk 104' of a second electromagnetic clutch 105', the two clutch disks being spaced axially from each other. Behind each clutch disk 104, 104' there is arranged a respective coil holder 106, 106' fixedly connected with bearing support 101 and containing respective energizing coils 107, 107'. Each clutch disk 104, 104' comprises an annular clutch member 108, 108' of U-shaped cross section, which carries a respective annular friction disk 109, 109'. Respective cylindrical extensions **108*a*, 108*a'* of clutch members 108, 108' extend over a major portion of the circumferential wall of the associated coil holders 106, 106' containing the respective energizing windings 107, 107'**.

Between clutch members 108, 108', there are arranged two bushings 110 and 110' on shaft 103, and the ends of these bushings are spanned by an externally threaded spindle 111. Respective pins 112 connect threaded spindle 111 and bushings 110 and 110' with shaft 103. Each bushing 110, 110' has a respective bearing flange 113, 113' for a clutch disk 114, 114' designed as an armature disk, and clutch disks 114, 114' are adjacent to the respective friction inserts 109, 109' with a small air gap therebetween. Each clutch disk 114, 114' is formed with a respective square opening 115, 115' into which there extends a respective square shoulder 116, 116' of the respective bushing 110, 110'.

On its circumference, clutch member 108 of electromagnetic clutch 105 is formed with teeth 117 which mesh with a gear 118 secured on a shaft 119 mounted in bearing support 102. Gear 118 meshes with a gear 120 secured on main shaft 1 of the machine. Clutch member 108' of electromagnetic clutch 105' is also formed with teeth 117' which mesh with the gear 121 secured on main shaft 1.

A nut 122 is threaded on spindle 111 and carries a setting member 123 with a cam 124 which cooperates with an inclined face 125 of a take-off 126. Take-off 126 is secured to the end of extension arm 9 connected with guide rocker 5 of needle 4, and guided in a slideway 127 of bearing support 102. Nut 122 carries a guide pin 128 which slides in a groove 129 of a straight guideway 130 secured on bearing support 102. In the same manner as with actuating means 16 and 40, a potentiometer 68 is provided for actuating means 101, and its moveable element is connected with shaft 133.

When the sewing machine is driven, clutch disk 104 is driven by main shaft 1, through gears 120 and 118, in the same angular direction as the direction of rotation of main shaft 1. On the contrary, clutch disk 104' is driven directly by gear 121 secured on main shaft 1, so that it revolves in a direction opposite to the direction of rotation of clutch disk 104. By the associated control loop for the control of the two clutches 105, 105', which, in principle, corresponds to the control loop of FIG. 7, the excitation of the two energizing windings 107 and 107' is varied in accordance with the supplied control voltage corresponding to the size of the overstitch width of the next stitch to be controlled, the voltage being supplied in reversed manner to the two windings 107 and 107' as a result of which magnetic fields of correspondingly different intensity are induced in clutch members 108 and 108'. That clutch, 105 or 105', which has a stronger magnetic field as compared with its previous states effects, through an increased moment of attraction on the associated clutch disk 114 or 114', a decreased slip of this clutch disk, while the slip of the disk of the clutch having a reduced magnetic field is increased. In this way, the threaded spindle 111, connected with clutch disks 114 and 114', is rotated. By the rotation of threaded spindle 111, setting member 123 is moved in the axial direction, through nut 122, with cam 124 changing its position along inclined face 125 of take-off 126 and rotating extension arm 9 through take-off 126. Thereby, the position of guide rocker 5 is adjusted to the new desired stitch.

In the same manner as for control of guide rocker 5 for needle 4, actuating means 101 can also be used for control of the fabric feed system through lever arm 33 of FIGS. 1, 2 and 3, instead of actuating means 40. The setting force of actuating means 40 or 101, for setting member 39, is so strong that fabric feed 50 can be controlled not only through the adjusting system, consisting in FIG. 1 of the parts 23 through 30, but can be driven also directly by actuating means 40 or 101 selected for that purpose. In such a solution, pull rod 32 is connected directly to arm 43 of swinging lever 44 and parts 23 through 30 and 42 and eliminated.

With such a design, of course, the control pulse as supplied by program control section 74 must be adapted to the control conditions as altered as compared with the indirect drive of fabric feed 50. Furthermore, it is then necessary also to control the end positions of fabric feed 50, controlled by the control pulses for the stitch forming cycle of the sewing machine, so that the feed movement of fabric feed 50 is executed during the non-insertive phase of needle 4 and the inoperative backward movement of fabric feed 50 is executed during the insertive phase of needle 4.

Setting member 39 need not have a cam track 38 whose contour rise serves as a displacement parameter, but the displacement parameter can be obtained also by the magnitude of the angular displacement of the setting member. In such an arrangement, the setting member may be designed, for example, as a lever arm which is firmly connected with shaft butt 62 and to which rod 32 is articulated.

The invention is not limited to the illustrated electromagnetic friction clutches, as described for the two different embodiments. There may also be used other clutches whose moment to be transmitted is controllable, such as, for example, pneumatic or hydraulic clutches, or electromagnetic powder clutches.

While specific embodiments of the invention have been shown and described in detail to illustrate the application of the principles of the invention, it will be understood that the invention may be embodied otherwise without departing from such principles.

What is claimed is:

1. In a sewing machine for making successive stitches of decorative stitch patterns, including a main shaft, a sewing needle, a fabric feed, at least one setting member, for adjusting one of the overstitch width and the stitch length, an actuating means adjusting each setting member responsive to control signals from a program control system, the improvement comprising, in combination, a drive continuously operated during rotation of said main shaft; clutch means including a first clutch disk connected to said setting member to rotate therewith and a second clutch disk connected to said drive for rotation thereby; and reset means operatively associated with each setting member and acting to rotate the associated setting member in a direction opposite to the direction of rotation of said drive.

2. In a sewing machine for making successive stitches of decorative stitch patterns, the improvement claimed in claim 1, in which each reset means is a spring connected at one end with the associated setting member and at the other end with the housing of the sewing machine.

3. In a sewing machine for making successive stitches of decorative stitch patterns, the improvement claimed in claim 2, in which each setting member comprises a cam disk with a spiral cam track; and a respective take-off engaged with each spiral cam track and actuating the control of one of the needle and the fabric feed.

4. In a sewing machine for making successive stitches of decorative stitch patterns, the improvement claimed in claim 3, in which the pitch direction of the cam track of the setting member is co-directional with the force direction of the associated spiral spring.

5. In a sewing machine for making successive stitches of decorative stitch patterns, the improvement claimed in claim 1, in which the second and driven clutch disk of each clutch is in drive connection with said main shaft through a step-down transmission.

6. In a sewing machine for making successive stitches of decorative stitch patterns, the improvement claimed in claim 1, in which the clutch means comprises a slip-ringless electromagnetic clutch.

7. In a sewing machine for making successive stitches of decorative stitch patterns, including a main shaft, a sewing needle, a fabric feed, at least one setting member, for adjusting one of the overstitch width and the stitch length, an actuating means adjusting each setting member responsive to control signals from a program control system, the improvement comprising, in combination, a drive continuously operated during rotation of said main shaft; said actuating means comprising two clutches operable in respective opposite directions and whose movement to be transmitted is controllable; each clutch including a respective first clutch disk connected to said setting member and a respective second clutch disk connected to said drive to rotate therewith.

8. In a sewing machine for making successive stitches of decorative stitch patterns, the improvement claimed in claim 7, in which each setting member is connected with a respective nut; a respective threaded spindle threadedly engaged with each nut and connected with both first clutch disks; and a take-off on said nut and effecting control of one of said needle and said fabric feed.

9. In a sewing machine for making successive stitches of decorative stitch patterns, the improvement claimed in claim 7, in which the second driven clutch disk of each clutch is in drive connection with said main shaft through a step-down transmission.

10. In a sewing machine for making successive stitches of decorative stitch patterns, the improvement claimed in claim 7, in which said clutch comprises a slip-ringless electromagnetic clutch.

* * * * *